United States Patent [19]

Wilson

[11] 4,053,060

[45] Oct. 11, 1977

[54] CRANE

[76] Inventor: Virgil D. Wilson, 8720 Selger Drive, Springfield, Va. 22153

[21] Appl. No.: 658,043

[22] Filed: Feb. 13, 1976

[51] Int. Cl.[2] ..... B66C 23/36

[52] U.S. Cl. ..... 212/48; 212/46 A; 212/58 R

[58] Field of Search ..... 280/22, 23, 24, 81 R; 212/1, 29, 46, 58 R, 59 R, 59 A, 66–69, 57, 48, 49

[56] References Cited

U.S. PATENT DOCUMENTS

| | | | |
|---|---|---|---|
| 3,045,837 | 7/1962 | Liebherr et al. | 212/46 B |
| 3,190,457 | 6/1965 | Linden | 212/70 |
| 3,280,931 | 10/1966 | Cahill et al. | 180/23 |
| 3,308,967 | 3/1967 | Barkley et al. | 212/144 |
| 3,385,014 | 5/1968 | Haug | 180/9.48 |
| 3,545,627 | 12/1970 | Le Tourneau | 212/145 |
| 3,631,988 | 1/1972 | Noly | 212/144 |
| 3,638,805 | 2/1972 | Garnier | 280/6 H |
| 3,734,302 | 5/1973 | Durand | 212/1 |
| 3,767,061 | 10/1973 | Tax et al. | 212/144 |

*Primary Examiner*—Lawrence J. Oresky
*Attorney, Agent, or Firm*—Cushman, Darby & Cushman

[57] ABSTRACT

A mobile rotary crane that can easily be moved on site while assembled, transported on the highway when disassembled, and lift large loads with a full range of movement. A vehicular support supports a crane base for rotary movement with respect thereto, the vehicular support having a pair of end sections with multiple axle wheel trains pivotally mounted with respect thereto. A center section of the vehicular support includes outrigger means for providing a wide base of support during lifting with the crane. A main boom section is pivotally mounted to the crane base, and lever arms disposed at right angles with respect to the main boom and mounted on a common center therewith provide for lifting of the main boom from a generally horizontal position, whereat any number of sections comprising the main boom may be attached together, to its generally vertical operating position. A jib boom is pivotally mounted on the load side of the main boom, and counterweight is disposed on the crane base on the opposite side of the main boom as the jib boom. A tower that is at least 1/3 the length of the jib boom, extends from the main boom, and provides support for the cable assembly for pivoting the jib boom with respect to the main boom. A reeving assembly extends on the load side of the tower, associated with cable extending between the tower and the jib boom, and a strongback assembly is provided on the counterweight side of the main boom.

28 Claims, 9 Drawing Figures

CRANE

BACKGROUND AND SUMMARY OF THE INVENTION

The invention relates to a rotary mobile crane that is capable of handling very large loads, lifting the loads to very large heights, working in a confined area (being able to deposit loads directly at the base of the crane) while still having great range, and one that can be broken down for easy transport on all types of highways, on most without requiring the securement of special permits and the like. There are a large number of rotary mobile cranes in the prior art, such as those disclosed in U.S. Pat. Nos. 2,924,341, 3,045,837, and 3,190,457. While such cranes are generally useful, they are not readily adaptable for the ready lifting and moving of very large loads over a full range of movement as is the present invention.

The mobile rotary crane of the present invention comprises a mobile vehicular support, a crane base mounted on the vehicular support for rotation with respect thereto, and an assemblable main boom pivotally mounted to said crane base, and movable from a generally horizontal position, whereat it can be assembled and disassembled, to a generally vertical position, the normal operating position thereof. Great lifting power is obtainable with the crane by the provision of a jib boom pivotally mounted to the main boom on the load side thereof, a tower extending upwardly from the main boom and providing a support for cables and pulley arrangements for pivoting the jib boom with respect to the main boom, the tower being at least ⅓ the length of the jib boom, and counterweight mounted on the crane base on the side of the main boom opposite the load side thereof. Provision is made to prevent the jib boom from tipping over when the jib boom is in a substantially vertical position by providing a reeving assembly for the cable for pivoting the jib boom on the load side of the main boom. Means for movement of the main boom into vertical operating position, and for allowing booming out of the main boom during lifting (to increase the horizontal range of movement, and to preclude tipping over of the crane when being moved along the ground while assembled) comprise a pair of lever arms disposed at a substantially 90° angle with respect to the main boom, cables extending around pulleys mounted on the free ends of the lever arms being attached at one end thereof to the free end of the main boom, and at the other end thereof to a drive assembly for allowing the cables to be pulled in and let out to thereby pivot the main boom about its horizontal pivot axis. Extra support may be provided for the main boom by spud booms disposed on either side of the main boom and attached along the horizontal pivot axis thereof, and by a strongback assembly including a pair of cables attached to the top of the tower and the cables for lifting the main boom, and passing over an extension of the main boom on the counterweight side thereof.

Ease of movement of the crane is provided, both with the main boom assembled for on-the-job movement, and for transport along the highway, by the mobile vehicular support. The vehicular support includes a pair of end sections and a center section, the center section mounting the crane base thereon. Each end section has mounted thereto a wheel train assembly, a plurality of axles associated with each wheel train assembly. At least some of the wheels of each wheel train are steerable, and at least some of the wheels of at least one of the wheel trains are powered. The wheel trains are mounted for pivotal movement with respect to the end sections both about a horizontal and a vertical axis to allow both for steering thereof and movement thereof on inclined ground. A plurality of rams extend between each of the wheel trains and their respective end sections to insure that the end sections remain horizontal at all times during vehicular movement despite the incline of the terrain on which the wheels of the wheel trains are moving. Outrigger means are provided with the center section of the vehicular support, extending from each side thereof, for stabilization of the crane during lifting therewith. Stabilizing rams are associated with both outrigger means and with the center section for lifting the wheels of the wheel trains slightly off the ground during operation of the crane, the stabilizing rams providing a solid base for supporting the crane during lifting. The crane base includes main beams and a cross-beam, the main boom being pivotally mounted to the main beams at the intersection thereof with the cross-beam. The cross-beam may be detached from the crane base, along with the main boom, for ease of transport on highways (the vehicular support being no wider than a normal highway lane, and the beams being spaced apart no more than the width of a normal highway lane), and the main beams may be removable from the crane base also, and the outrigger means pinned up in a vertical position for ease of transport with the vehicular support.

It is the primary object of the present invention to provide an improved rotary mobile crane that can lift heavy loads, has a full range of movement with minimal chance of tipping, and can be moved easily on site while assembled, or on the highways after disassembly. This and other objects of the invention will become clear from an inspection of the detailed description of the invention, and from the appended claims.

DETAILED DESCRIPTION OF THE INVENTION

Figure 1:
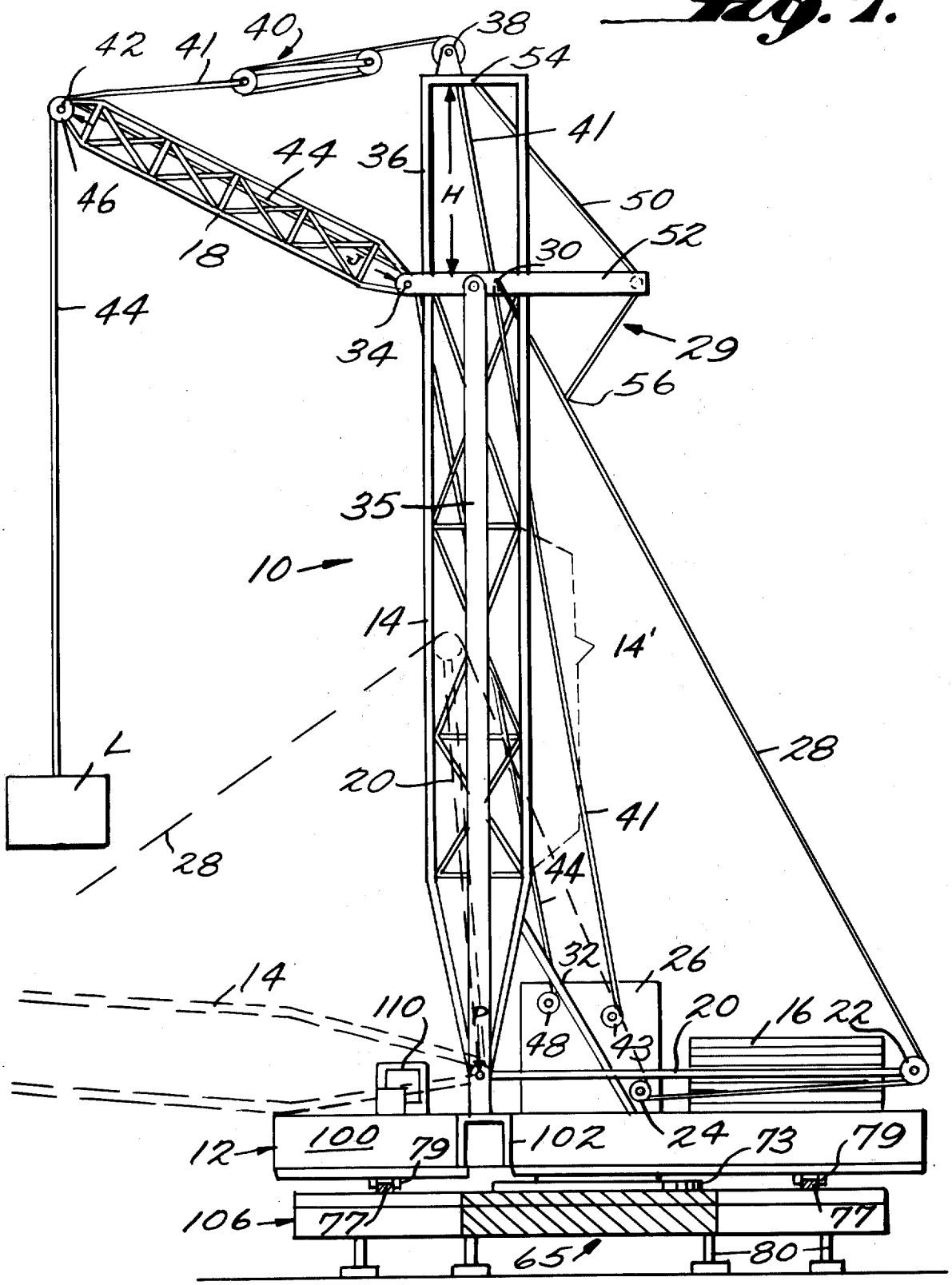
FIG. 1 is an end view, with portions of the vehicular support cut away for clarity, of an exemplary mobile rotary crane according to the present invention in a normal operating position thereof.

A mobile rotary crane according to the present invention is shown in exemplary form generally at 10 in the drawings. The crane generally comprises a crane base 12 and a main boom 14 pivotally mounted to the base 12 at points P on a common horizontal line. On one side of the main boom 14 are mounted counterweights 16, which counterweights 16 may take the form of flat sections that may be stacked atop one another until the desired weight is reached. The side of the boom 14 of base 12 on which the counterweights are mounted will hereinafter be referred to as the counterweight side of the boom. On the side of the boom 14 opposite to the counterweight side is pivotally mounted a jib boom 18 (adjacent the free end of boom 14) for lifting loads L off the ground. The side of the boom 14 on which the jib boom 18 is mounted will hereinafter be referred to as the load side of the boom. Preferably, the boom 14 takes the form of a plurality of sections (one such section being shown schematically at 14' in FIG. 1) which may be bolted together to form a boom of any desired length, the boom 14 being assembled when disposed in a generally horizontal position (shown in dotted line in FIG. 1).

Pivotedly mounted with respect to base 12 at a common center (P) with the main boom 14 are a pair of lever arms 20 disposed at substantially a 90° angle with respect to the main boom 14. At the end of each lever arm 20 is a pulley 22, and a cable 28 extends around each pulley 22 from a point of attachment 30 to the top of the main boom 14, to a drive winch or pulley 24. Each drive winch or pulley 24 may be powered by any suitable means, such as a diesel engine 26 mounted directly on the base 12. By driving the pulleys 24, the cables 28 are let out and the lever arms 20 and boom 14 pivot from the position shown in solid line in FIG. 1 to the position shown in dotted line in FIG. 1. When the boom 14 is pivoted from the dotted line position to the solid line position in FIG. 1, it is prevented from moving past a center position by the arms 32 which are rigidly attached to the base 12 at one end thereof, and abut the boom 14 when it is in truly vertical position. In the truly vertical position shown in solid line in FIG. 1, the arms 32 prevent movement of the boom to the counterweight side thereof, and the cable 28, together with a strongback arrangement 29 to be described further, prevents movement of the boom 14 toward the load side.

The jib boom 18 is pivotally mounted at 34 to a top section 52 of the boom 14. Extending above the section 52 of the main boom 14 is a tower 36. Mounted atop the tower 36 is a pulley assembly 38 which in cooperation with the reeving assembly 40 (shown diagrammatically in FIG. 1) provides for pivotal movement of the jib boom 18, and a load L supported thereby, with respect to the main boom 14. The height H of the tower 36 is chosen so that it is at least ⅓ as great as the length J of the jib boom 18, this provides for maximum lifting power of the jib boom 18 given the strength of the construction materials used. It is particularly pointed out that the reeving assembly 40 is disposed on the load side of the main boom 14. This is because the reeving is rather heavy compared to the weight of the jib boom, and if the reeving assembly 40 were disposed on the counterweight side of the main boom, there would be a tendency for the jib boom 18 to tilt over when it is moved to vertical position (see FIG. 6), especially since the counterweight 16 would be disposed on the same side as the reeving assembly 40. A cable 41 is attached to the end of the jib boom 18, and extends through the reeving assembly 40 back down to a drive winch or pulley 43, rotation of the pulley 43 resulting in pivotal movement of the boom 18 with respect to the tower 36. A pulley 42 is mounted on the free end of jib boom 18, and a cable 44 goes around pulley 42 and back to a drive winch or pulley 48 or the like, rotation of pulley 48 either pulling in or playing out the cable 44 and thus either lifting or lowering the load L with respect to the jib boom 18.

Extra support for the main boom 14 in its vertical, normal operating position, may be provided by a pair of spud booms 35, one disposed on each of two opposite sides of main boom 14, and being also mounted at the common center P, a horizontal straight line extending through the mounts for the spud booms 35, lever arms 20, and main boom 14 through the points P thereof, said line forming a first horizontal axis P—P. A strongback assembly 29 is also provided in the form of an extension 52 of the top of the main boom disposed on the counterweight side of boom 14, and a pair of cables 50. Each of the cables 50 is attached at one end thereof to a point 54 at the top of the tower 36, and at the other end thereof to a point 56 on a respective cable 28, in between the points 54, 56, the cables 50 being in engagement with the extension 52. The strongback assembly 29 provides reaction forces to the load L on the tower 36 and main boom 14 such that the larger the load lifted, the more stable the crane 10, within the strength of the materials used for construction of the crane 10.

Figure 6:
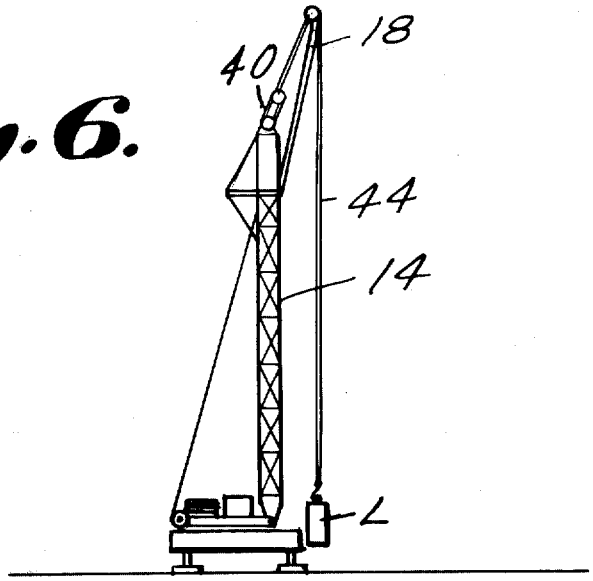
FIG. 6 is a diagrammatic view of the crane of FIG. 1 illustrating the capability of the crane to deposit a load directly at the base of the crane.

The provision of the tower 36 and jib boom 18, and the common center (P) mounting of the component parts of the crane 10, allows the load L to be placed almost at any position from directly next to the base 12 to the farthest reach of the jib 18 and main boom 14. As shown in FIG. 6, heavy loads may be deposited directly next to the base 12 during normal operation of the crane 10, in contradistinction to heavy-duty mobile cranes now on the market which cannot properly place a load directly next to the base thereof. Also, if the boom 18 is in a horizontal position and it is desired to place the load L at still a more remote point from the base 12, the pulley 24 may be energized, and the boom 14 pivoted slightly to the load side thereof the necessary distance.

Figure 4A:
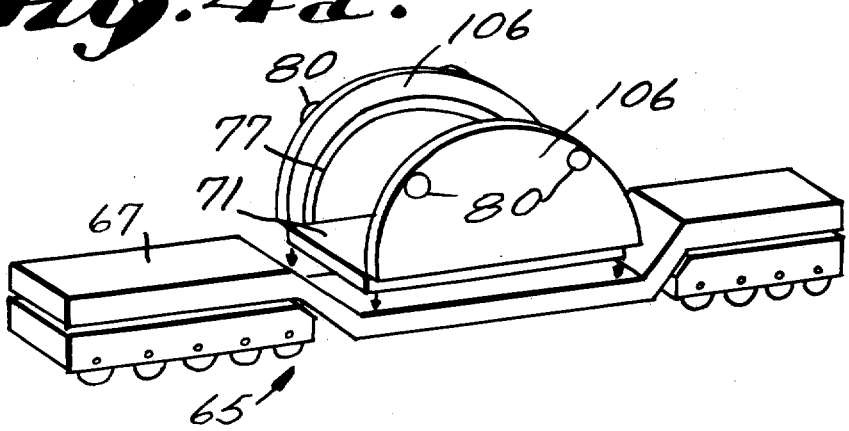
FIG. 4*a* is a schematic showing of only the vehicular support of the crane of FIG. 2 in one optional transporting position thereof.

The base 12 is mounted on a vehicular support, shown generally at 65 (see FIG. 2), and is rotatable with respect to the vehicular support 65. As shown most clearly in FIG. 2, the support 65 includes one end section, 67, a middle section 69 disposed at a lower level than the end section 67, and on which the crane base 12 is directly mounted, and a second end section 68. Each of the end sections 67, 68 is mounted on a wheel train 82, 82'. Mounted on the center section 69 is a platform 71 having outriggers 106 (see FIGS. 4a and 7) extending therefrom, the platform 71 and outriggers 106 in cooperation therewith supporting a track 77. Graphite hooks 79 or the like extending from the base 12 engage the underside of lip portions of the track 77 for guiding base 12. (The actual track 77 engaging portions of hooks 79 cannot be seen in FIG. 2 in view of the small scale of the drawing.) A toothed circular support rail 73 (see FIGS. 2 and 7) is mounted on the platform 71 and also supports the base 12 for rotation with respect to the support 65. One or more driven toothed wheels 75 may be provided for cooperation with the toothed rail 73, the drive for one or both of the wheels 75 being provided by any suitable conventional source, such as the diesel motor 26, and rotation of the wheels 75 resulting in movement of the base 12 with respect to the rail 73 and vehicular support 65. Also, a number of rollers 74 may be provided if desired, attached to base 12, and abutting the top of rail 73, to facilitate free rotation of the base 12 with respect to platform 71. The entire crane base 12 is thus rotatable 360° with respect to the support 65. While one particular means has been shown for mounting the base 12 for rotation with respect to the support 65, it is to be understood that many other conventional types of supports, drives, and guides may be provided in addition to or in place of those shown.

When the main boom 14 is disposed in its vertical position and is prepared for lifting, stabilizing rams 80, which are provided on the center section 69 and the outriggers 106, are actuated, and engage the ground and lift the whole support 65 until the wheels 85, 85' of the wheel trains 82, 82' are spaced slightly from the ground. Preferably, eight or more stabilizing rams 80 are provided to ensure stable, stationary support for the crane during lifting. While the wheel trains 82, 82' are supported off the ground, they may be pivoted (by any suitable means, powered or manual) about center pivot arrangement 88 thereof to any particular orientation with respect to the end sections 67, 68 for future movement of the crane (compare FIGS. 3*a* and 3*b*. During movement of the crane while assembled (with rams 80 retracted), it is desirable to boom the main boom 14 out slightly with cable 28 to counterbalance the counterweight 16 to minimize the chance of the crane tipping over during movement.

Each of the wheel trains 82, 82' includes a plurality of axles 84, 84' mounting wheels 85, 85'. Preferably 5 axles may be provided associated with wheel train 82 and vehicular support end section 67 (which supports engine 86), and 4 axles may be provided associated with wheel train 82' and vehicular support end section 68. Each wheel train 82, 82' is mounted for pivotal movement with respect to the respective end sections 67, 68 in both a vertical and horizontal plane. This may be accomplished by a pivotal support 88, including a pair of axles 90 attached to both an end section (67, 68) and its respective wheel train (82, 82') and allowing pivotal movement in a vertical plane (the B direction — see FIG. 5), and a shaft 92 connected to each wheel train and its corresponding end section for allowing pivotal movement of the wheel train with respect to the vehicular support in a horizontal plane (the A direction — see FIG. 3*a*). Alternatively, a universal joint may be provided at the point of attachment of the shaft 92 to a wheel train 82, 82' to allow pivotal movement in both the A and B directions.

Figure 5:
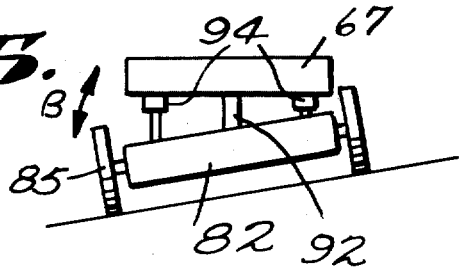
FIG. 5 is a diagrammatic view showing the vehicular support for the crane when the crane is operating on uneven terrain.

Pivotal movement of the wheel trains 82, 82' with respect to the vehicular support 65 is provided so that when the crane 10 is being moved on uneven terrain, it can be moved safely, without fear of it being tipped over. This is accomplished by the rams 94 which are connected to the vehicular support end sections 67, 68 and cooperate with the wheel trains 82, 82' to pivot end sections 67, 68 in direction B the desired amount with respect to the wheel trains 82, 82'. When the wheels 85 on one side of the wheel train 82 are disposed on ground lower than the ground on which the wheels 85 on the other side of the wheel train 82 are supported, the rams 94 on the lower side are actuated, applying a force to lift up the vehicular end 67 with respect to the wheel train 82, the wheel train 82 pivoting about shafts 90 (or a universal joint for shaft 92, as shown in FIG. 5) until the vehicular support is horizontal so that the crane will not tip over during movement. Of course the rams 94 may be energized automatically in response to tilt switches or the like located on the vehicular body, or by any other suitable means. A rough schematic showing of the vehicular support end section 67 with respect to the ground when there is uneven terrain is shown in FIG. 5.

The base 12 may take any form convenient for ready transport of the crane 10, with boom 14 disassembled, on highways. The vehicular support 65 is made wide enough so that it can be maintained within a lane on a highway, or substantially within a lane so that a special permit for transport may be obtained therefor. One form that the base 12 may take that greatly facilitates transport of the crane 10 is shown most clearly in FIGS. 1, 2, and 7. A pair of parallel, spaced support beams 100 extend from the counterweight side of the boom 14 to the load side of the boom. A floor section, 104, is disposed between the two support beams 100, and supports a control cage 110 (a crow's nest control area may be provided in place of or in addition to the control cage 110), the counterweight 61, a diesel engine 26 or the like, and the arms 32. Extending substantially perpendicular to the beams 100 at a point thereof generally where a vertical plane containing a side edge of the vehicular support 65 intersects the beams 100, is a cross-beam 102. The main boom 14 is mounted to the beams 100 at the intersection of the beams 100 with cross-beam 102, and the spud booms 35 are mounted at the ends of the cross-beam 102, the cross-beam 102 extending through all the points P forming the common centerline of the crane 10. The floor portion 104 may also extend on the load side of the boom 14 from the cross-beam 102 to the beams 100. The toothed wheel drives 75 or the like preferably are disposed below the floor 104. The cross-beam 102 may be detached from the beams 100, merely being bolted thereto, for ease of transport. In such a case, as shown schematically in FIG. 4b, when the boom 14 is completely disassembled and the outriggers 106 and cross-beam 102 detached, the beams 100 may be rotated so that they are parallel to the direction of elongation of the vehicular support 65, and transported in that position. Preferably, the weight of the beams 100 and associated structure will be designed so that, combined with the weight of the support 65 and given the number of axles 84, 84' for the wheel trains 82, 82', the vehicular support 65 does not exceed the per axle road limits on the highways on which it will be travelling. Of course the distance between beams 100 will be less than or equal to the width of support 65. If the beams 100 would be too heavy for the support 65 to allow it to travel on highways, the beams 100 could also be removed (and the toothed wheels 75 and drive therefor also detached), and the outriggers 106 pinned in a vertical position (see FIG. 4*a*).

Figure 2:
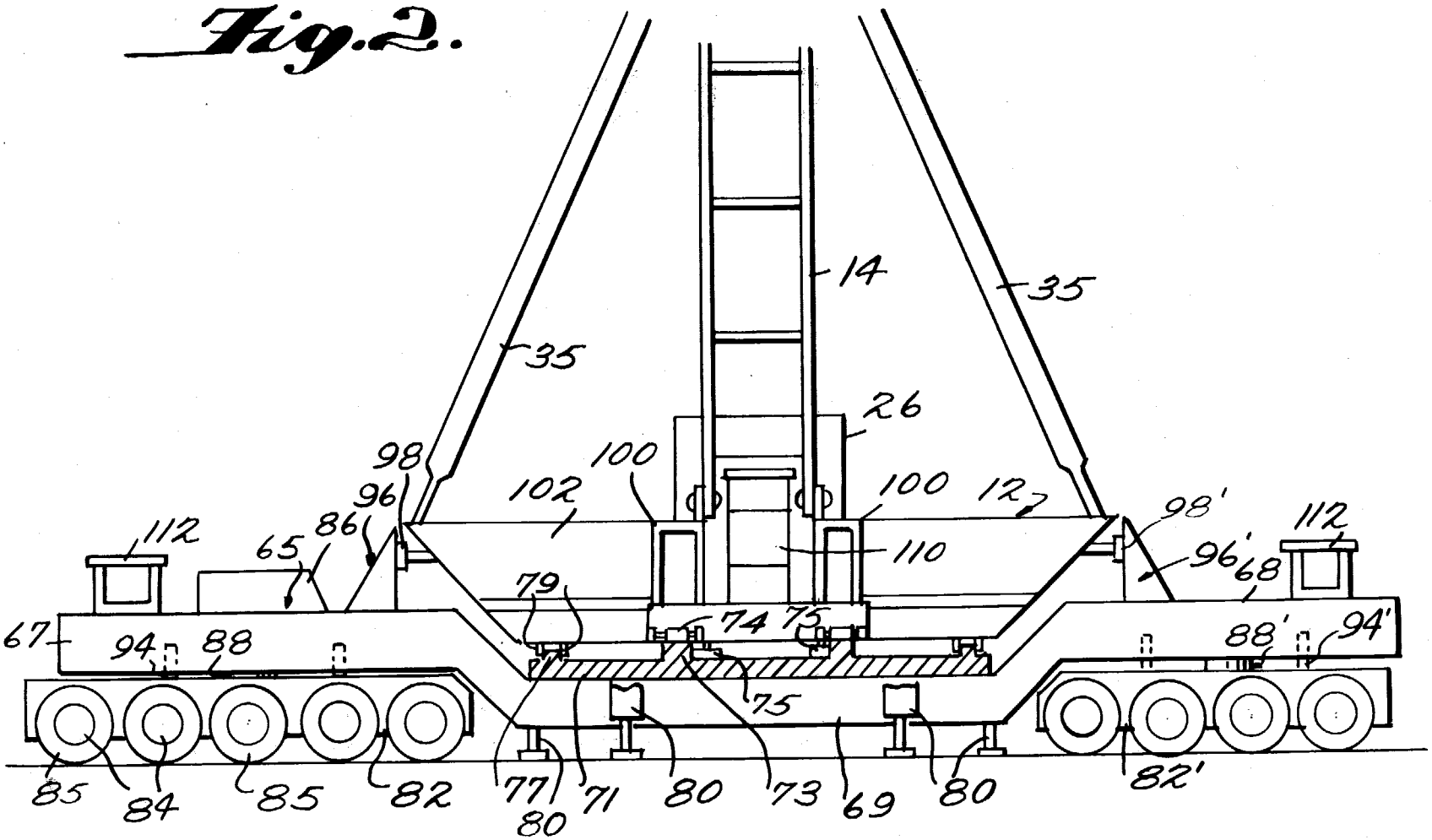
FIG. 2 is a side view of a portion of the crane of FIG. 1, partly in elevation and partly in cross-section, showing the crane in a stationary lifting position.
Figure 3A:
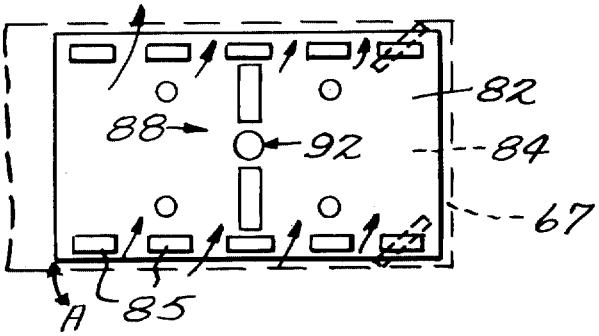
FIG. 3*a* is a diagrammatic top view of one of the wheel assemblies of the vehicular support of the crane of FIG. 2 shown in one position thereof.
Figure 3B:
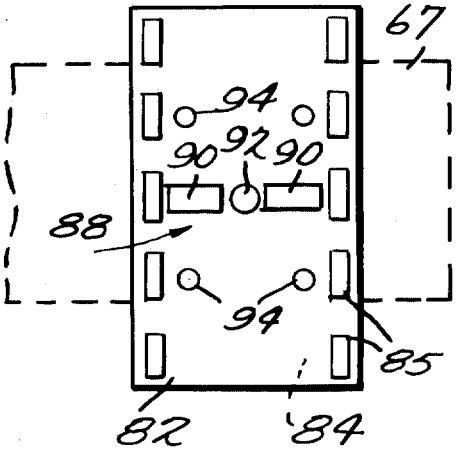
FIG. 3*b* is a diagrammatic top view similar to FIG. 3*b* rotated 90° from the position of FIG. 3*a;*
Figure 7:
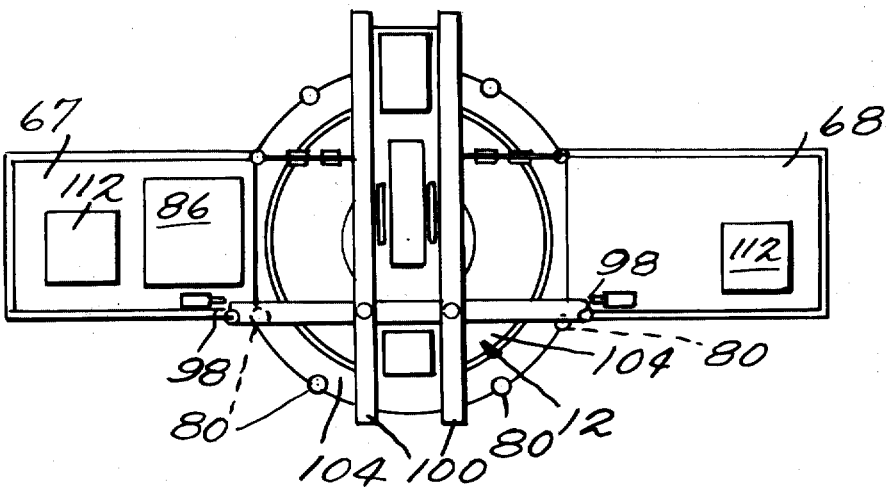
FIG. 7 is a top plan view, with the boom 14 and supporting structure therefor cut away, of the assembly of FIG. 1.

Any suitable drive may be provided for the vehicular support 65, such as a diesel engine 86 mounted on one of the end sections (67 — see FIG. 7). All or just some of the axles 84 for the wheel train 82 may be powered, and all or some of the wheels 85, 85' can be made steerable (as shown in dotted line for the rightmost wheel set 85 in FIG. 3a). With all the wheels 85 of train 82 steerable, as shown in FIGS. 3*a* and 3b, the support 65 will be able to turn most corners om a highway on which it is travelling. Control towers 112 for steering of the wheel trains 82, 82' may be provided on the support 65, as shown in FIGS. 2 and 7.

Figure 4B:
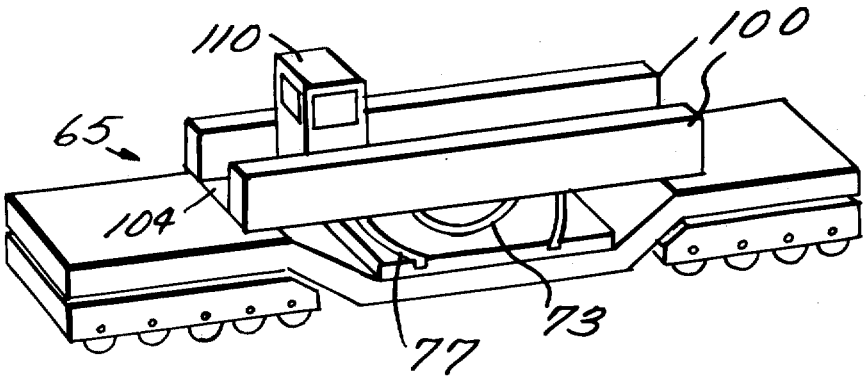
FIG. 4*b* is a schematic showing similar to FIG. 4*a* showing a second optional transporting position of the vehicular support.

Mounting plates 96,96' having hydraulic rams 98, 98' operatively attached thereto, may be provided on end sections 67, 68 (see FIGS. 2 and 7) for engaging the ends of beams 100 of crane base 12 and holding them in a secure, nonrotatable position with respect to the vehicular support 65 for moving the crane on the highway (see FIG. 4b).

It will thus be seen that according to the present invention, a mobile rotary crane has been provided that allows the lifting of much larger loads for a given strength and size of the materials than conventional cranes, and that allows a much larger range of movement of loads moved thereby, the crane according to the present invention including a jib boom and tower, reeving on the load side of the main boom, and a common center horizontal axis for the main boom and lever arms and spud booms associated therewith. The crane base and booms are mounted on a vehicular support that allows ready transport of the crane on highways when the crane is disassembled, and allows movement of the crane when assembled from one place to another on the job without problems with the crane tipping over, and while still being able to provide solid support therefor.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A mobile rotary crane comprising a. a mobile vehicular support, b. a crane base, c. means for rotating said crane base with respect to said vehicular support with said vehicular support in a stationary position, d. a main boom pivotally mounted with respect to said crane base for pivotal movement in a vertical plane about a first horizontal axis from a generally horizontal position to a generally vertical position, said main boom having a free end, e. means for mounting counterweight on said base on one side of said main boom, said main boom extending away from said counterweight when in said generally horizontal position thereof, f. a jib boom pivotally mounted to said main boom at a portion thereof near the free end thereof for rotation about a second horizontal axis and located on the load side of said main boom, opposite the counterweight side thereof, said jib boom having a free end, g. a tower extending from said main boom free end and providing a substantial continuation of said main boom, h. a first cable connected to the free end of said jib boom, extending over said tower, and to a drive assembly on said crane base, said drive assembly for letting out and pulling in said cable to pivot said jib boom with respect to said tower and said main boom, i. a lever arm pivotally mounted to said crane base for pivotal movement in a vertical plane about said first axis, said lever arm extending generally perpendicularly to said main boom toward the counterweight side, and operatively attached to said main boom, and having a free end with a pulley attached thereto, and j. a second cable extending from a portion of said main boom adjacent the free end thereof around said pulley and to a drive assembly, said drive assembly for letting out and pulling in said second cable to pivot said main boom and said lever arm about said first axis to any position between said generally horizontal and generally vertical position of said main boom.

2. A crane as recited in claim 1 further comprising a reeving assembly in cooperation with said first cable and extending between said tower and said jib boom on the load side of said main boom, said reeving assembly for facilitating pivotal movement of said jib boom by said first cable.

3. A crane as recited in claim 1 further comprising an arm means mounted on said crane base on the counterweight side of said main boom for abutting said main boom and preventing pivotal movement thereof past said vertical position thereof toward the counterweight side.

4. A crane as recited in claim 1 further comprising a strongback assembly for said main boom on the counterweight side thereof.

5. A crane as recited in claim 4 wherein said strongback assembly comprises a horizontal extension toward said counterweight side from substantially said free end of said main boom, and a taught third cable attached to a portion of said tower spaced from said main boom, and said second cable, said third cable extending over said extension in between the points of connection to said tower and said second cable.

6. A crane as recited in claim 1 further comprising power means mounted on said crane base on the counterweight side of said main boom for powering said drive assemblies for said first and second cables.

7. A crane as recited in claim 1 further comprising a pair of spud booms mounted to said crane base at said first horizontal axis, one on either side of said main boom.

8. A crane as recited in claim 1 wherein said main boom comprises a plurality of sections that are assemblable together to form a main boom of any desired length.

9. A crane as recited in claim 1 wherein said crane base comprises a pair of parallel spaced beams extending from the load side of said main boom to the counterweight side of said main boom, and a cross-beam extending substantially perpendicular to and intersecting said beams, said cross-beam extending in the same vertical plane as said first horizontal axis, and said main boom pivotally mounted to said beams at the areas of intersection of said beams with said cross-beam, each of said beams extending a shorter distance on the load side of said main boom from said main boom than on the counterweight side of said main foom from said main boom.

10. A crane as recited in claim 9 wherein said cross-beam is detachably connected to said beams so that said mobile vehicular support can travel on highways when said main boom is disassembled and said cross-beam is detached, said beams being spaced apart a distance no greater than the width of a highway lane, and said vehicular support being no wider than a highway lane.

11. A crane as recited in claim 10 wherein said beams are detachable from said mobile vehicular support for movement thereof on a highway after disassembly of main boom.

12. A crane as recited in claim 1 wherein said mobile vehicular support comprises a center section for mounting said crane base, a pair of end sections, one on either side of said center section, a pair of multiple axle wheel trains, at least some of the wheels of each train being steerable, means for mounting one of said multiple axle wheel trains to each of said end sections for pivotal movement about a vertical axis, so that said wheel train axles are movable from a position perpendicular to the direction of elongation of said vehicular support to a position parallel thereto, and power means for driving at least some of the axles of one of said multiple axle wheel trains.

13. A crane as recited in claim 12 wherein said mobile vehicular support further comprises means for mounting said multiple axle wheel trains to respective end sections for pivotal movement with respect to said end sections about a horizontal axis, and means extending between said end sections and said wheel trains for providing support of said end sections in a horizontal plane despite the configuration of the ground engaged by the wheels of said wheel trains.

14. A crane as recited in claim 13 wherein said means extending between said end sections and said wheel trains include a plurality of rams extending between each end section and each wheel train.

15. A crane as recited in claim 12 further comprising a plurality of supporting rams connected to said center section of said vehicular support for lifting said vehicular support until the wheels of said wheel trains are slightly off the ground.

16. A crane as recited in claim 15 wherein said vehicular support further comprises detachable outrigger means for connection to either side of said center section of said vehicular support, and a plurality of supporting rams connected to said outrigger means for facilitating lifting of said wheel train wheels off the ground while providing stable support for said crane for lifting.

17. A crane as recited in claim 12 wherein said means for rotating said crane base with respect to said vehicular support comprises a platform mounted on said center section of said vehicular support and having a toothed circular rail disposed thereon, and a pair of toothed wheels attached to said crane base and in operative engagement with said circular rail, powered rotation of one or both of said toothed wheels resulting in rotation of said crane base relative to said platform.

18. A crane as recited in claim 17 wherein said means for rotating said crane base with respect to said vehicular support further comprises a lipped circular rail extending on said platform on said center section of said vehicular support and extending on outrigger means disposed on either side of said center section, and a plurality of graphite hook slides extending from the bottom of said crane base and engaging said lipped circular rail for guided movement with respect thereto.

19. A crane as recited in claim 18 wherein said means for rotating said crane base with respect to said vehicular support further comprises roller means mounted on said crane base and engaging a smooth top portion of said toothed circular rail for movement thereon.

20. A crane as recited in claim 1 wherein said tower is at least ⅓ as long as said jib boom.

21. A crane as recited in claim 1 further comprising hydraulic ram stabilizing means mounted on said vehicular support for engaging said crane base and holding it in a secure, non-rotatable position when said crane base is in a normal operating position with respect to said vehicular support.

22. A crane as recited in claim 1 further comprising a second lever arm corresponding to said lever arm and a fourth cable extending around the pulley mounted on the end of the second lever arm and to said main boom, and wherein said lever arms when disposed in a horizontal position straddle said counterweight, and are disposed at a substantial 90° angle with respect to said main boom.

23. A crane as recited in claim 22 further comprising a pair of strongback cables, one associated each with said second and fourth cables.

24. A mobile rotary crane comprising a. a mobile vehicular support including a center section and a pair of end sections, b. a crane base rotatably mounted on the center section of said mobile vehicular support, c. a pair of multiple axle wheel trains, at least some of the wheels of each train being steerable, d. means formounting one of said multiple axle wheel trains to each of said end sections for pivotal movement about a vertical axis so that said wheel train axles are movable from a position perpendicular to the direction of elongations of said vehicular support to a position parallel thereto, e. power means for driving at least some of the axles of one of said multiple axle wheel trains, f. a main boom pivotally mounted to said crane base for rotation about a mounted axis and a jib boom pivotally mounted to said main boom on the load side thereof, g. means for supporting counterweight on said crane base on the side of said main boom opposite the load side thereof, and h. means for rotating said said crane base with respect to said vehicular support, and i. said crane base comprising a pair of parallel spaced beams extending from the load side of said main boom to the counterweight side of said main boom, and a cross-beam extending substantially perpendicular to and intersecting said beams, said cross-beam extending in the same vertical plane as said horizontal axis, and said main boom pivotally mounted to said beams at the areas of intersection of said beams with said cross-beam, each of said beams extending a shorter distance on the load side of said main boom from said main boom than on the counterweight side of said main boom from said main boom.

25. A crane as recited in claim 24, wherein said cross-beam is detachably connected to said beams so that said mobile vehicular support can travel on highways when said main boom is disassembled and said cross-beam is detached, said beams being spaced apart a distance no greater than the width of a highway lane, and said vehicular support being no wider than a highway lane.

26. A crane as recited in claim 25, wherein said beams are detachable from said mobile vehicular support for movement thereof on a highway after disassembly of main boom.

27. A crane as recited in claim 24, further comprising stabilizing means mounted on said vehicular support end sections for engaging said main beams of said crane base and holding them in a secure, non-rotatable position when said crane base is positioned with respect to said vehicular support, for traveling along a highway.

28. A mobile rotary crane comprising a. mobile vehicular support including a center section and a pair of end sections, b. a crane base rotatably mounted on the center section of said mobile vehicular support, c. a pair of multiple axle wheel trains, at least some of the wheels of each train being steerable, d. means for mounting one of said multiple axle wheel trains to each of said end sections for pivotal movement about a vertical axis so that said wheel train axles are movable from a position perpendicular to the direction of elongations of said vehicular support to a position parallel thereto, e. power means for driving at least some of the axles of one of said multiple axle wheel trains, f. a main boom pivotally mounted to said crane base, and a jib boom pivotally mounted to said main boom on the load side thereof, g. means for supporting counterweight on said crane base on the side of said main boom opposite the load side thereof, h. means for rotating said crane base with respect to said vehicular support, and i. a plurality of supporting rams connected to said center section of said vehicular support for lifting said vehicular support until the wheels of said wheel trains are slightly off the ground, said vehicular support further comprising detachable outrigger means for connection to either side of said center section of said vehicular support, and a plurality of supporting rams connected to said outrigger means for facilitating lifting of said wheel train wheels off the ground while providing stable support for said crane for lifting.

* * * * *